US006979218B2

(12) United States Patent
Trout et al.

(10) Patent No.: US 6,979,218 B2
(45) Date of Patent: Dec. 27, 2005

(54) LEVER ACTUATED SOCKET WITH STATE INDICATOR

(75) Inventors: David Allison Trout, Lancaster, PA (US); Richard N. Whyne, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/353,339

(22) Filed: Jan. 29, 2003

(65) Prior Publication Data

US 2004/0147153 A1 Jul. 29, 2004

(51) Int. Cl.[7] ..... H01R 13/625
(52) U.S. Cl. ..... 439/342
(58) Field of Search ..... 439/342; 438/342

(56) References Cited

U.S. PATENT DOCUMENTS

| | | | | |
|---|---|---|---|---|
| 5,256,080 | A | 10/1993 | Bright | 439/342 |
| 5,697,803 | A * | 12/1997 | Kistner et al. | 439/342 |
| 6,280,223 | B1 | 8/2001 | Lin | 439/342 |
| 6,338,639 | B1 | 1/2002 | Trout et al. | 439/342 |
| 6,347,951 | B1 * | 2/2002 | Murr | 439/342 |
| 6,368,139 | B1 | 4/2002 | Ohkita et al. | 439/342 |
| 6,406,317 | B1 | 6/2002 | Li et al. | 439/342 |
| 6,435,893 | B1 * | 8/2002 | Kasahara | 439/342 |
| 6,450,825 | B1 * | 9/2002 | Huang | 439/342 |
| 6,638,095 | B1 * | 10/2003 | Chen et al. | 439/342 |
| 2003/0186578 | A1 * | 10/2003 | McClinton | 439/342 |

* cited by examiner

*Primary Examiner*—Javaid H. Nasri

(57) ABSTRACT

A socket is provided for an electronic package. The socket includes a cover and base that are slidably joined with one another. An actuator drives the cover and base between open and closed positions or states as the actuator is rotated through a range of motion between open and closed positions, respectively. The socket further includes a socket state indicator provided on the base and located proximate one of the actuator and the cover. The socket state indicator is positioned, such that a relative spacing between the socket state indicator and one of the actuator and cover indicates when the cover and base are in the open state. The socket state indicator may include a ramped detent provided within the actuator's range of motion. Alternatively, the socket state indicator may include posts formed on the base. The cover moves relative to the posts as the state of the socket changes. Alternatively, an interference member may be provided on the actuator to block the loading area above a pin hole pattern in the cover when the socket is not fully open.

3 Claims, 9 Drawing Sheets

LEVER ACTUATED SOCKET WITH STATE INDICATOR

BACKGROUND OF THE INVENTION

The present invention generally relates to an electrical socket, such as a pin grid array (PGA) socket. More specifically, certain embodiments of the present invention relate to a zero insertion force (ZIF) PGA socket that includes an indicator denoting the present state of the socket (e.g., partially or fully opened or closed).

Heretofore, ZIF PGA sockets have been proposed that include a base and cover slidably mounted together. The sliding motion between the base and cover is controlled with an actuator through numerous methods in conventional ZIF PGA sockets. For example, U.S. Pat. No. 5,256,080 discloses a bale actuated ZIF socket, while U.S. Pat. No. 4,498,725 discloses a PGA socket having an L-shaped lever that moves the cover. However, the foregoing sockets do not meet the space requirements placed on current designs. Consequently, new sockets have been proposed having different actuators that afford a more space efficient overall socket configuration.

For example, recently, a socket has been introduced, in which the cover and base are movable between open and closed positions along a socket longitudinal axis by an actuator that is aligned to rotate about a rotational axis that is parallel to the socket longitudinal axis. The actuator moves the cover and base between open and closed positions or states as the actuator is rotated about the rotational axis. A PGA socket of this type is described in U.S. Pat. No. 6,338,639.

However, certain embodiments of the PGA socket of the '639 patent have created some confusion with respect to operation of the actuator. The PGA sockets of the '080 and '725 patents have actuators typically (but not always) that are configured to operate over a 90-degree range of rotation. As the actuator is rotated from one end point to the opposite end of this 90-degree range of rotation, the actuator moves the cover between fully opened and fully closed positions. However, certain embodiments of the socket of the '639 patent, while more space efficient, utilize a longer actuator range of motion. For example, the actuator may rotate through a 135-degree range of rotation to move the cover between fully opened and closed positions. This extended range of motion has caused some confusion within users who normally expect the cover to be fully opened when the actuator is rotated 90 degrees from its closed position. Consequently, sockets having the longer range of rotation for the actuator are not fully opened prior to the user attempting to load an electronic package therein. The electronic package may become damaged if loaded when the cover is only partially opened. Such damage may arise if pins on the electronic package are forced into a partially open pin hole array in the cover. The pins on the electronic package may also only sit on top of, without becoming fully seated to, the contacts held in the socket. When the pins on the electronic package and the contacts in the socket are only partially joined, a risk exists for arcing during operation. For the foregoing reasons and others, it is desirable that the user fully open the socket before loading an electronic package.

A need remains for an improved socket that addresses the above concerns and overcomes these and other problems experienced heretofore.

BRIEF SUMMARY OF THE INVENTION

A socket is provided that includes a cover and base that are slidably joined with one another to receive an electronic package. The socket also includes an actuator that drives the cover and base between open and closed positions or states. The actuator drives the cover and base between the open and closed states as the actuator is rotated through a range of motion between open and closed positions, respectively. The socket further includes a socket state indicator provided on the base and located proximate one of the actuator and the cover. The socket state indicator is positioned such that a relative spacing between the socket state indicator and one of the actuator and cover indicates whether the cover and base are in the open state.

In accordance with one embodiment, the socket state indicator includes a wall spaced apart from an end of the base to form a passage between the wall and base. The actuator rotates along the passage when moving between the open and closed positions. The wall includes a ramped detent extending from one side thereof that resists motion of the actuator as the actuator rotates along an arcuate path past the ramped detent. Once the actuator moves past the ramped detent, a tactile release is felt which corresponds to the point at which the actuator reaching the open position.

In accordance with an alternative embodiment, the socket state indicator includes a post extending upward from the base. The post extends through an opening in the cover and is smaller than the opening to permit the cover to move about the post. The post is positioned within the opening such that a relative spacing between the post and the opening in the cover indicates when the cover and base are in the open state. Optionally, the post may be provided upon flexible beams formed in the base, where the beams are deflected downward below a top surface of the cover to accept a large electronic package on the socket. The post may also serve as an alignment element against which smaller electronic packages are placed to align the pins on the smaller electronic package with the pin hole array in the socket. The opening in the cover may be ovally shaped and oriented such that the post moves along the oval shaped opening to serve as a visual indicator of when the cover is in the open and closed states.

In accordance with an alternative embodiment, a socket is provided for an electronic package, in which the socket includes a cover and base slidably joined with one another. The cover and base are movable relative to one another along a longitudinal axis between open and closed states. The socket includes an actuation member that engages and moves the cover and base between the open and closed states as the actuation member rotates about a rotational axis aligned parallel to the longitudinal axis. The socket state indicator is provided as an interference element that is joined to the actuation member. The interference element moves along an arcuate path over the top surface of the cover. The arcuate path extends through a load area proximate the pin hole array in the cover. The electronic package is moved along a loading path perpendicular to the cover when inserted onto the socket. The interference element blocks the loading path when the actuation member is positioned at an intermediate point along its range of rotation corresponding to a socket state at which the base and cover are not fully opened. The interference element may constitute a bar formed on an end of the actuation member that is oriented to project over the pin hole array in the top surface of the cover.

Figure 1:
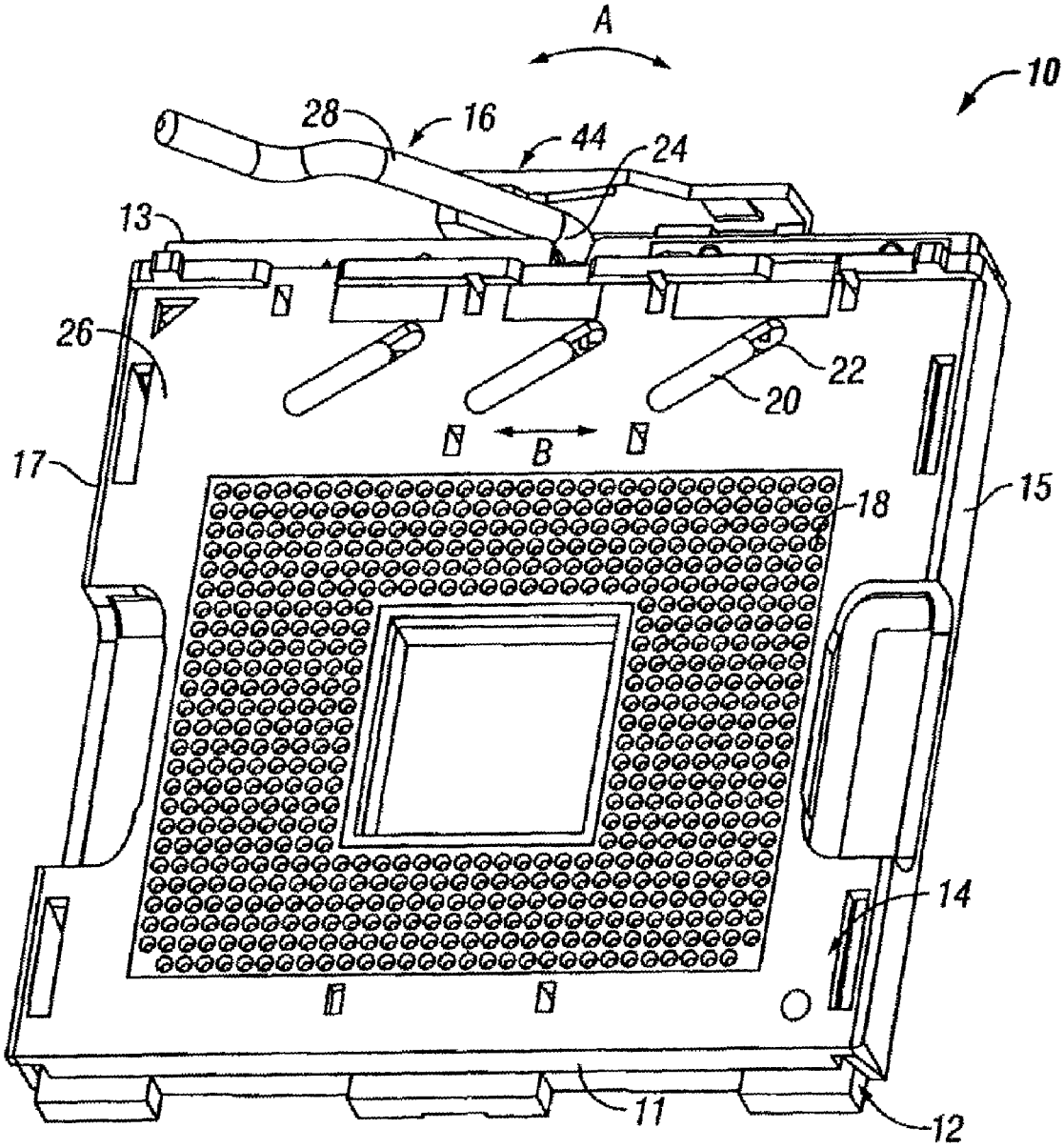
FIG. 1 illustrates an isometric view of a socket formed in accordance with an embodiment of the present invention while in a fully open state.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

Figure 3:
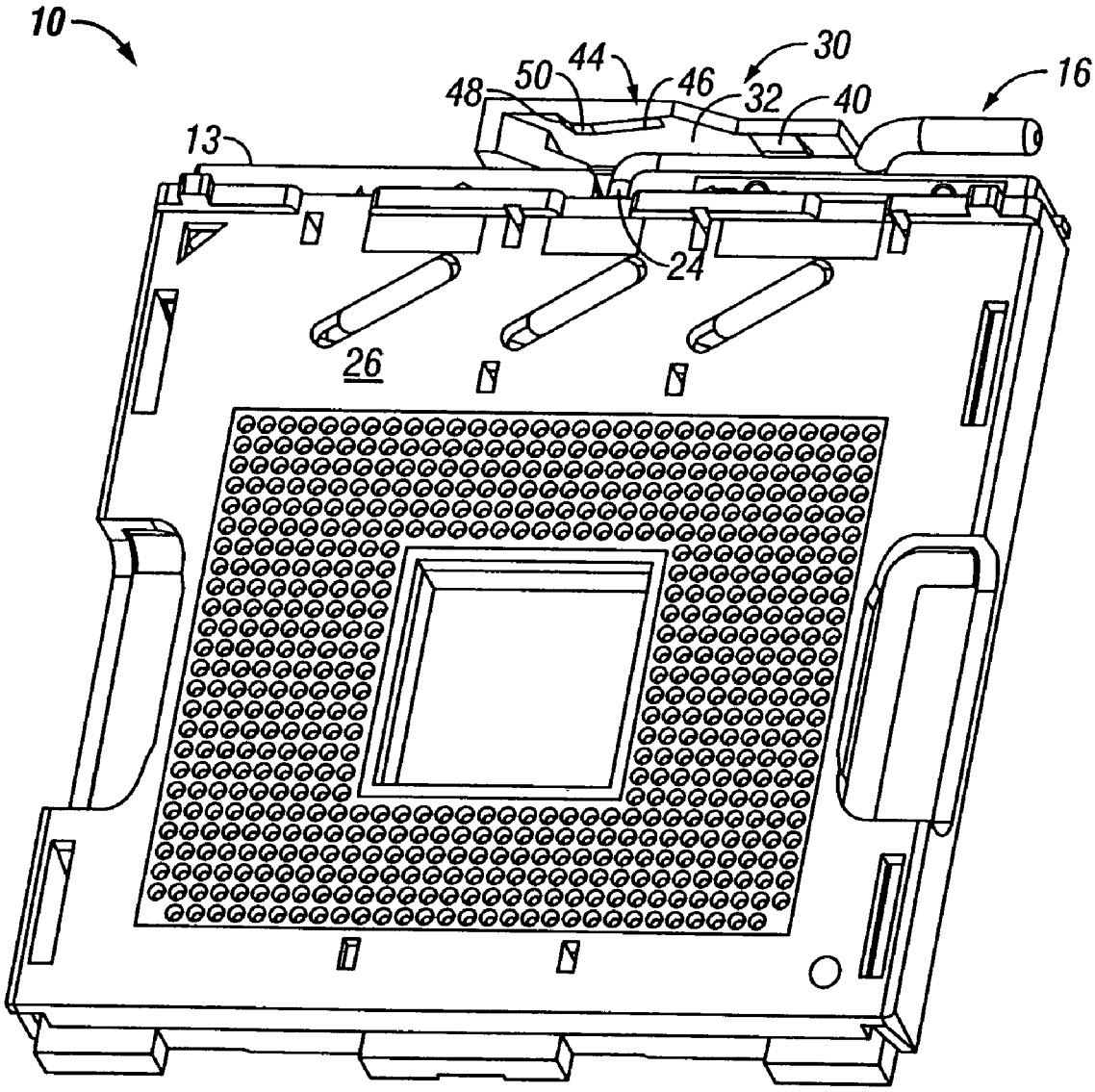
FIG. 3 illustrates an isometric view of the socket of FIG. 1 while in a fully closed state.

FIGS. 1 and 3 illustrate a socket 10 formed in accordance with an embodiment of the present invention when in open and closed states, respectively. The socket 10 includes a front end 11, a back end 13, and sides 15 and 17. The socket 10 generally includes a base 12 and a cover 14 slidably engaging one another. The base 12 and cover 14 are moved between open and closed states by an actuation member, such as a lever 16, which rotates along arcuate path A between an open position (FIG. 1) and a closed position (FIG. 3). The cover 14 includes a pin hole pattern 18 corresponding to a processor pin pattern, while the base 12 includes a pin hole pattern (not shown) corresponding to the pin hole pattern 18 in the cover 14. The lever 16 drives a cam assembly (not shown) that is held between the base 12 and cover 14. The cam assembly may be formed similar to the cam assembly described in U.S. Pat. No. 6,338,639, which is expressly incorporated herein in its entirety by reference.

The lever 16 includes a leg 24 and handle 28 formed at a 90-degree angle with one another. The leg 24 extends between the base 12 and cover 14 and includes a cam element formed proximate its outer end that engages the cam assembly (not shown) that is held between the base 12 and cover 14. As the leg 24 rotates about its longitudinal axis, the cam element drives the cam assembly along a linear path denoted by arrow B. The cam assembly includes pusher bars 20 projecting upward therefrom through angled slots 22 formed in the cover 14. The pusher bars 20 are slidably received within the slots 22 and are arranged such that the longitudinal axes of each of the pusher bars 20 extend parallel to one another and are aligned at an acute angle with respect to the linear path B along which the cam assembly travels. As the cam assembly moves in the direction of arrow B, the pusher bars 20 slidably engage the side walls of the slots 22, thereby causing the cover 14 to slide relative to the base 12, along a path perpendicular to linear path B, between the open and closed states.

Figure 2:
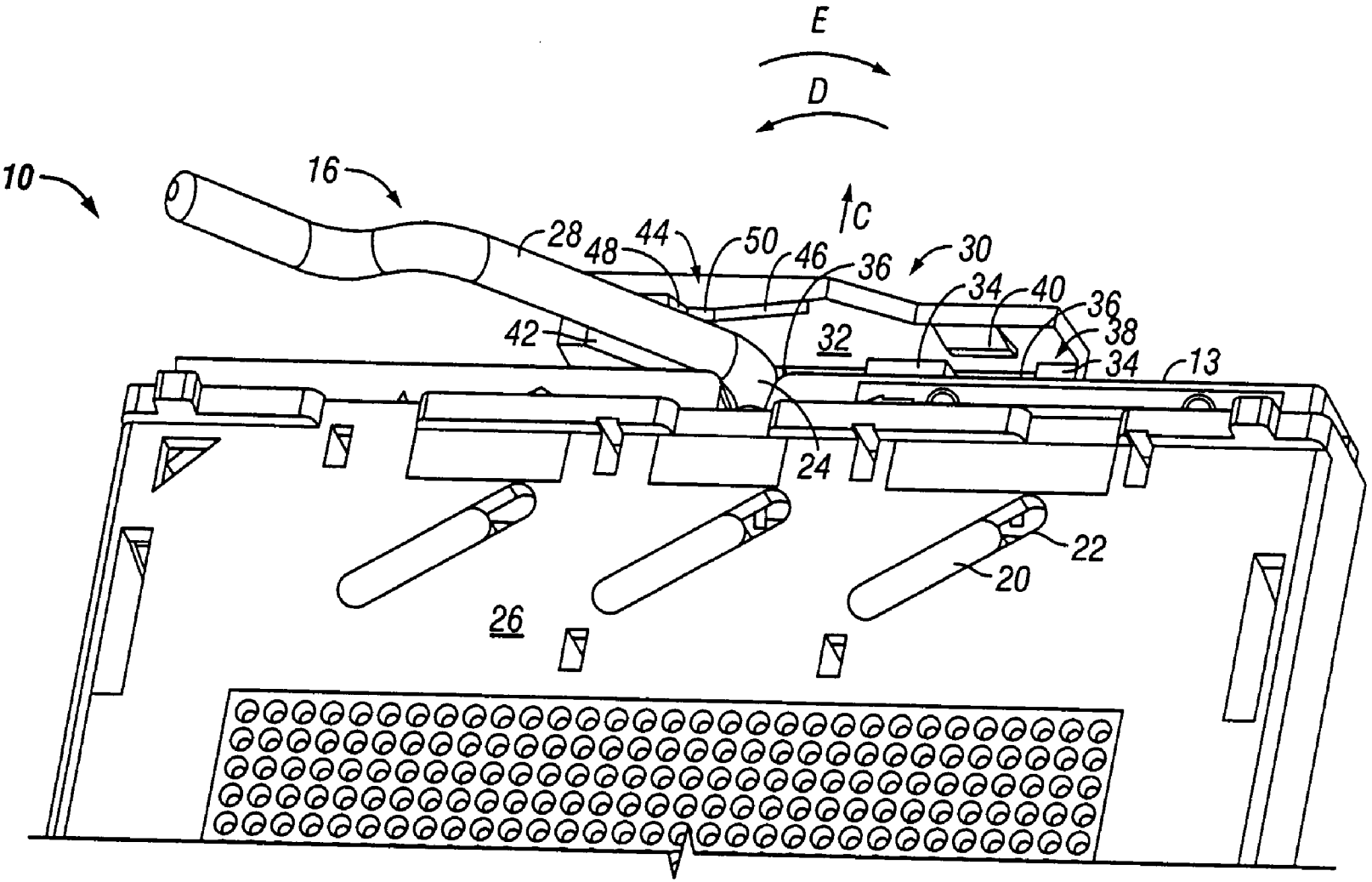
FIG. 2 illustrates a partial isometric view of an actuation member on the socket of FIG. 1.

FIG. 2 illustrates a portion of the socket 10 of FIG. 1 when in the open state. The socket 10 includes a shroud 30 formed on the back end 13 of the base 12 and positioned to enclose the lever 16. The shroud 30 includes a wall 32 oriented perpendicular to the base 12 and cover 14. The wall 32 is spaced apart from the base 12, yet joined to the back end 13 of the base 12, by spacers 34. The spacers 34 are separated by gaps 36 which accept a portion of the mold used to form the base 12 and shroud 30 integral with one another. Optionally, the shroud 30 may not necessarily be formed integral with the base 12, but instead may be joined thereto through a variety of means. The gap 36 proximate the leg 24 of the lever 16 also enables the wall 32 to flex outward in the direction of arrow C during rotation of the lever 16. A passage 38 is formed between the wall 32 and the back end 13 of the base 12. The passage 38 accepts the handle 28 as the lever 16 is rotated. A latch 40 is provided on the wall 32 and formed with a beveled upper surface to permit passage of the handle 28 when rotated in the direction of arrow D until resting against the spacers 34. The latch 40 retains the lever 16 in a horizontal position substantially parallel to the plane of the top 26 of the cover 14 which corresponds to the fully closed state (FIG. 3).

FIG. 3 illustrates the lever 16 fully rotated to the closed position at which the socket 10 is in a fully closed state. Latch 40 retains the lever 16 in its closed position.

Returning to FIG. 2, the shroud 30 further includes a stop 42 formed at an end of the shroud 30 opposite to the latch 40. The stop 42 includes a sloped surface extending at an obtuse angle to the plane of the top 26 of the cover 14. The lever 16 is rotated in the direction of arrow E until resting against the stop 42 at an obtuse angle with respect to the plane of the cover 26 which corresponds to the fully open state.

The shroud 30 further includes a state indicator 44 formed on the wall 32 and projecting inward toward the base 12 and cover 14. The state indicator 44, as shown in FIG. 2, constitutes a ramped detent formed with and extending from the wall 32. The state indicator 44 includes sloped leading and trailing surfaces 46 and 48, respectively, separated by a plateau 50 that engage the handle 28 as the lever 16 is rotated in either direction. The leading surface 46 may have a longer, less inclined, slope with respect to the wall 32 than the trailing surface 48. During rotation of the lever 16, the leading surface 46 resists motion of the handle 28 when moving in the direction of arrow E until reaching the plateau 50. As the handle 28 moves in the direction of arrow E along the leading surface 46, the wall 32 may flex outward away from the base 12. The leading surface 46 provides a progressively increased resistance to motion of the handle 28 until the handle 28 reaches the plateau 50. Once the handle 28 passes plateau 50 (continuing in the direction of arrow E), the state indicator 44 no longer resists motion of the handle 28. Instead, as the handle 28 moves off the plateau 50, a tactile release or let-off is experienced by the operator due in part to the steep slope of the trailing surface 48 which drives the lever 16 in the direction of arrow E. A more immediate tactile release may be afforded by forming the trailing surface 48 at even a steeper angle or at a right angle to the wall 32. The tactile release informs the operator that the lever 16 has reached a fully open position corresponding to a fully open state of the socket 10.

Figure 4:
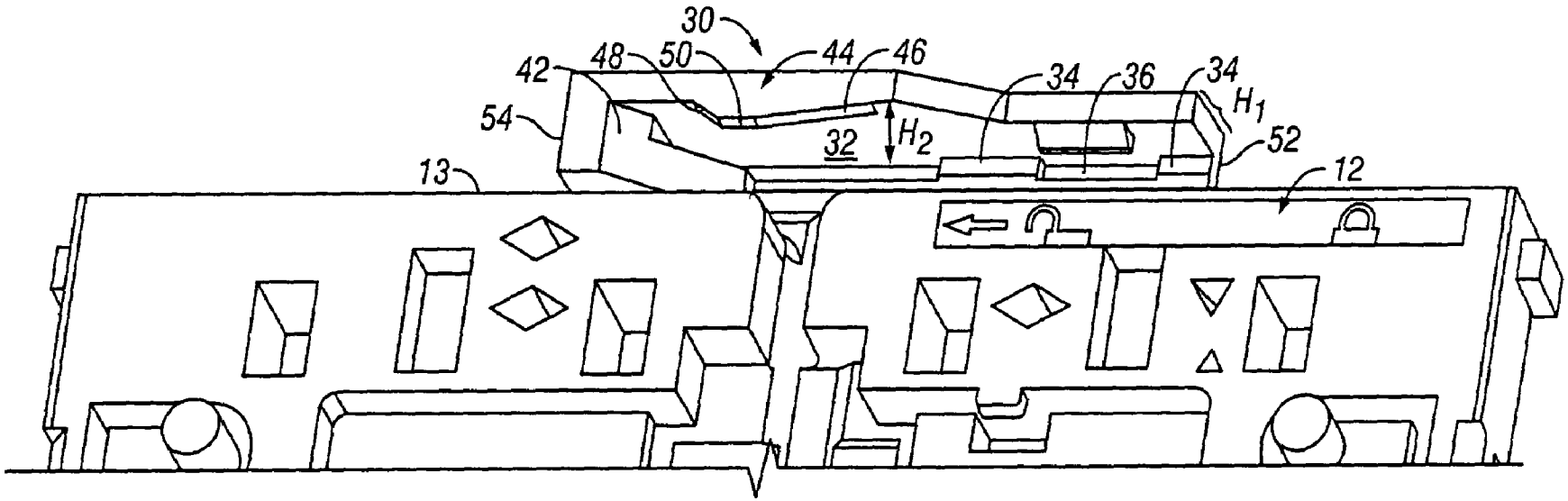
FIG. 4 illustrates an isometric view of a portion of a base for a socket formed in accordance with an embodiment of the present invention.

FIG. 4 illustrates a portion of the base 12 and the shroud 30 with the cover 14 removed. The wall 32 is better shown to be formed along the rear end 13 of the base 12 with a stepped height such that end 52 has a first height H1 and end 54 has a greater height. The wall 32 is formed with an intermediate height H2 that is sufficient to locate the state indicator 44 at a desired point along the handle 28 remote from the leg 24 (FIG. 2). The state indicator 44 is positioned at a point along the handle 28 (FIG. 2) sufficiently far from the rotational axis of the leg 24 to afford a desired amount of resistance during rotation in the direction of arrow E (FIG. 2) and the desired tactile release once the lever 16 passes the plateau 50. Consequently, the height H2 may be increased or decreased depending upon the length of the handle 28, upon the forces needed to close the socket 10, the type of cam assembly used, and the like.

Figure 5:
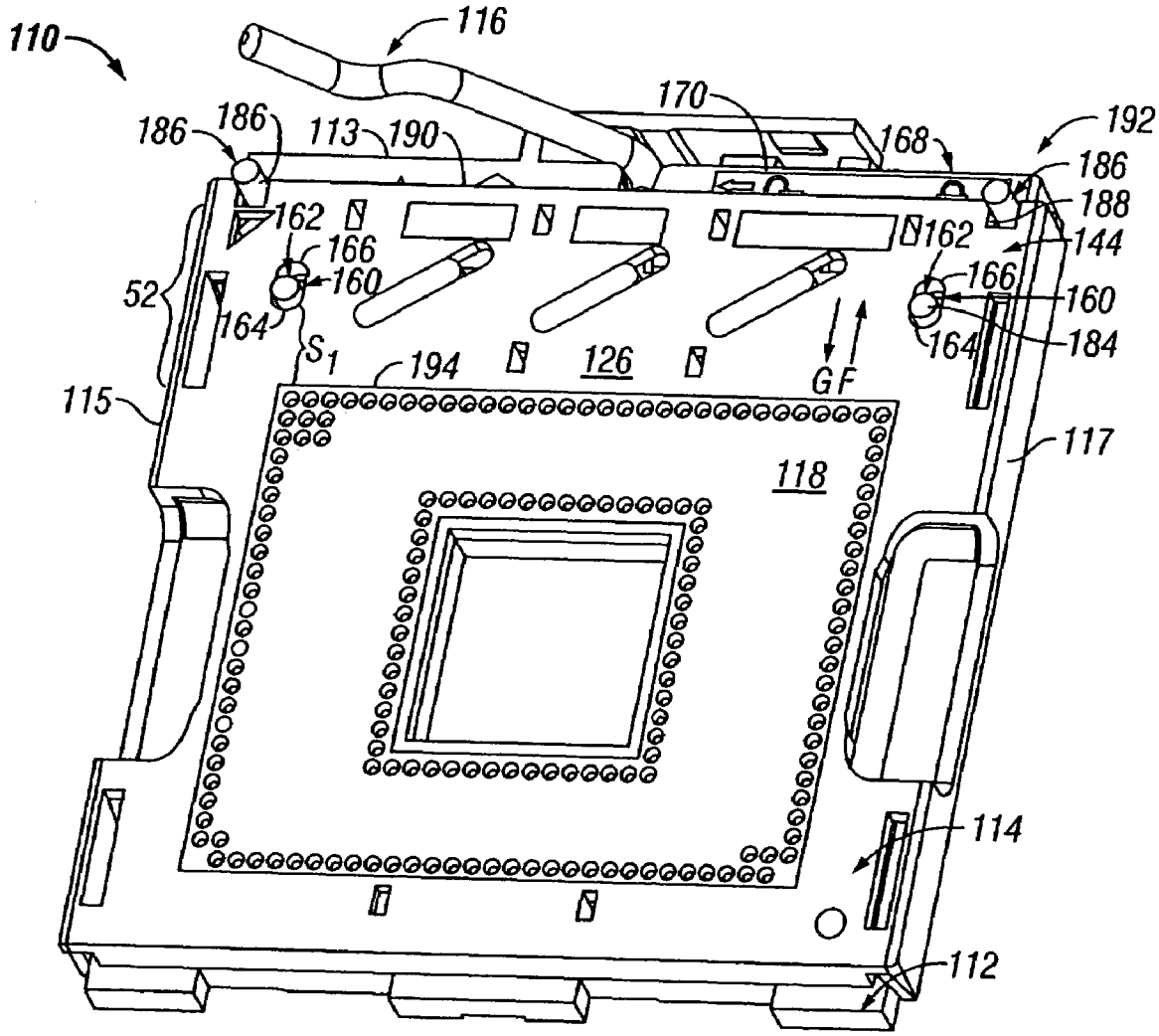
FIG. 5 illustrates an isometric view of a socket formed in accordance with an alternative embodiment of the present invention while in the fully open state.
Figure 6:
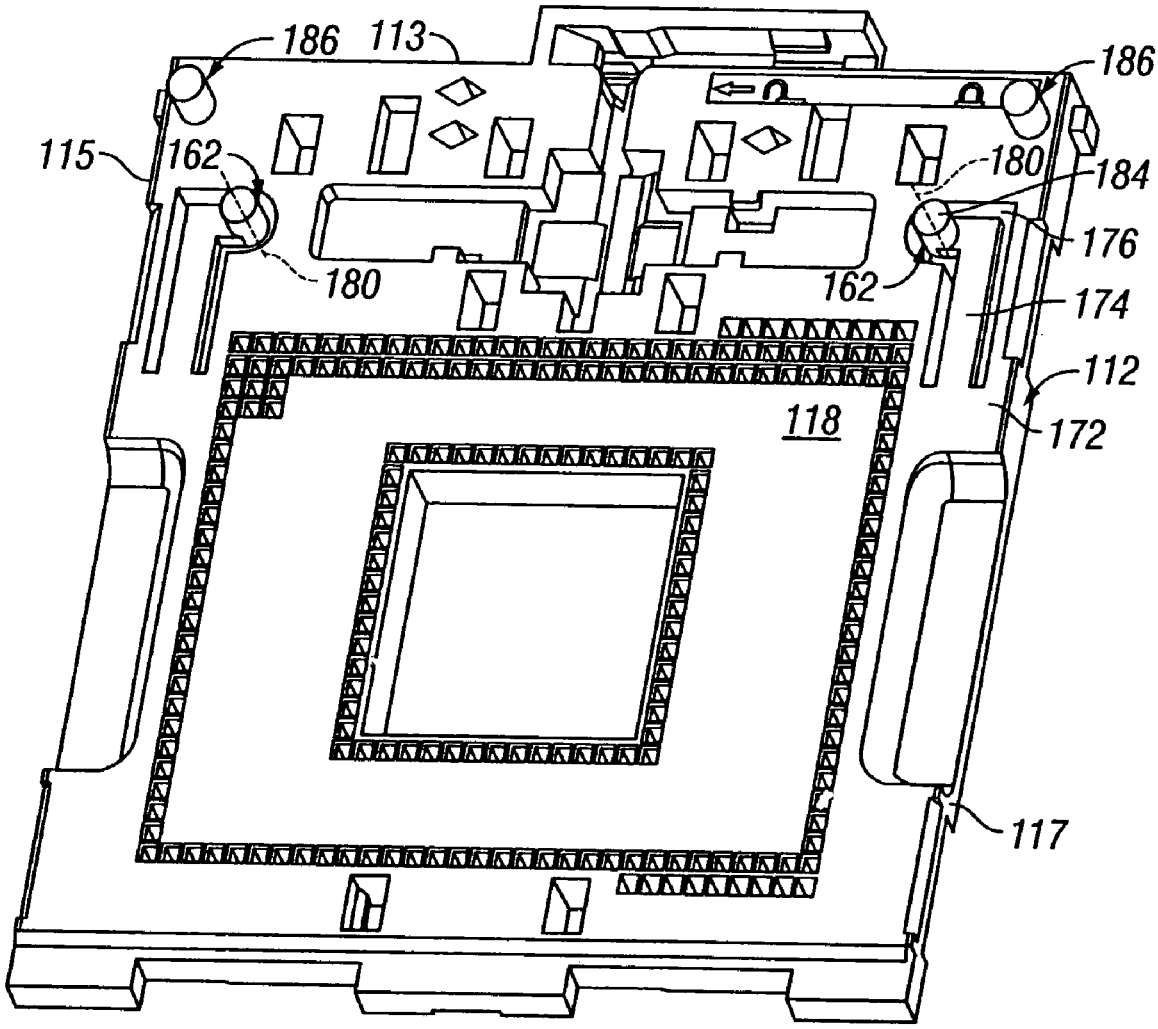
FIG. 6 illustrates an isometric view of the base for the socket of FIG. 5.

FIGS. 5 and 6 illustrate an alternative embodiment for a socket 110 implementing alternative state indicators 144 and 192. The socket 110 includes a base 112 and cover 114 slidably joined with one another and moveable between open and closed states by a lever 116. The state indicator 144 includes slots 160 formed in the top 126 of the cover 114. The slots 160 receive posts 162. As the cover 114 moves upon the base 112, the slots 160 move in the direction of arrows F and G relative to the posts 162. FIG. 5 illustrates the socket 110 in the fully open state at which posts 162 are located proximate forward ends 164 of the slots 160. While not illustrated, when the socket 110 is moved to the fully closed state, the posts 162 are located proximate rear ends 166 of the slots 160. The position of the posts 162 in the slots 160 indicates the state of the socket 110. Optionally, indicia may be provided proximate the forward and rear ends 164 and 166 of the slots 160 to denote which end corresponds to the closed and open states of the socket 110 (such as the indicia denoted by arrows 168 and 170).

FIG. 6 illustrates the base 112 in more detail. The base 112 includes a top surface 172 that includes L-shaped lever arms 174 integrally molded therewith. The lever arms 174 extend along and are biased to normally reside below or flush with the plane of the top surface 172. The lever arms 174 are located in L-shaped cavities 176 formed in the top surface 172. The cavities 176 need not necessarily be L-shaped, but instead may simply be rectangular, circular, square, and the like. Outer ends 178 of the lever arms 174 have the posts 162 formed therewith. The posts 162 extend along axes 180 which are oriented perpendicular to the plane of the top surface 172. The posts 162 project upward along the axis 180 above the plane of the top surface 172 by a distance sufficient to project beyond the slots 160 (FIG. 5).

The lever arms 174 enable the posts 162 to be bent downward until a top surface 184 of each post 162 is flush with the top surface 126 of the cover 114. The posts 162 perform two functions, namely as state indicators 144 as explained above and in addition as a mechanism for properly locating different sized packages upon the socket 110. More specifically, the socket 110 may be configured to receive electronic packages having different first and second sizes. Each of the electronic packages, even with different first and second sizes, include the same processor pin pattern. The portions of the electronic packages extending outward about the processor pin pattern are different in size.

Returning to FIG. 5, the socket 110 also includes state indicators 192 that have posts 186 located near the rear end 113 and near opposite sides 115 and 117 of the socket 110. The posts 186 serve as first locating members, while the posts 162 serve as second locating members. The posts 186 are positioned to engage an edge of an electronic package having a first (larger) size in order to align the processor pin pattern of the electronic package with a pin hole pattern 118 in the cover 114. The posts 162 are positioned to engage an edge of an electronic package having a second (smaller) size in order to align the processor pin pattern of the second electronic package with the pin hole pattern 118. In embodiments in which the posts 162 are intended to serve this second function (namely a locating member for a smaller size electronic package), the top surfaces 184 of the posts 162 extend upward beyond the top surface 126 of the cover 114. When the posts 162 are not intended to operate as locating members, but instead simply are intended to be state indicators 114, the top surfaces 184 may be formed to be below or flush with the top surface 126 and need not be on flexible lever arms 174.

When a large electronic package is mounted on the socket 110, the edge of the larger electronic package abuts against posts 186 as the electronic package is moved downward to rest on the top surface 126. As the large electronic package is moved to its final resting position on the socket 110, the bottom surface of the electronic package forces the posts 162 downward flush with the top surface 126 of the cover 114. The lever arms 174 flex to permit the posts 162 to move downward.

Optionally or in addition, the posts 186 may be provided. The posts 186 are formed rigidly on the base 112 (FIG. 6) and extend upward from the top surface 172. The posts 186 are aligned to fit within notches 188 formed in the rear edge 190 of the cover 114. When the socket 110 is in the fully open state, the cover 114 is slid in the direction of arrow F until the notches 188 fully receive the posts 186. When the socket 110 is in the fully closed state, the cover 114 is moved in the direction of arrow G until the posts 186 are substantially removed from or no longer within notches 188. By comparing the separation (or lack thereof) between the posts 186 and notches 188, the user may visually determine whether the socket 110 is in a fully open or fully closed state or some intermediate position therebetween. Hence, the spacing between posts 186 and notches 188 functions as a state indicator generally denoted by reference number 192. When state indicators 192 are provided, state indicators 144 may be removed.

Optionally, the notches 188 may be removed and the posts 186 simply made to abut against the rear edge of the cover 114.

In the embodiments in which the posts 162 and 186 also function as locating members, the user need not necessarily visually inspect the relation between the posts 162 and 186 and corresponding slots 160 and notches 188. Visual inspection is not necessary since, when the socket 110 is not in the fully open state, the spacing between the pin hole pattern 118 in the cover 114 and posts 162 and 186 prevents proper alignment with the processor pin pattern.

More specifically, the posts 162 and 186 move relative to the cover 114, and thus move relative to the pin hole pattern 118 in the cover 114 depending upon the state of the socket 110. As shown in FIG. 5, the posts 162 and 186 are spaced distances S1 and S2, respectively from the edge 194 of the pin hole pattern 118 when the socket 110 is in the fully open state. Posts 162 and 186 move with the base 112. Hence, when the socket 110 is not in the fully open state, the distances S1 and S2 increase as the posts 162 and 186 move further from the edge 194. When the socket 110 is at an intermediate state or in a fully close state, and an electronic package is attempted to be inserted, the edge of the package is placed against either post 162 or post 186. Consequently, the processor pin pattern on the electronic package does not correctly align with the pin hole pattern 118. The electronic package does not correctly align until the cover 114 is slid in the direction of arrow F to its fully open state. In this manner, the posts 162 and 186 operate as visual state indicators and physically prevent proper alignment of the electronic package until the socket 110 is in the fully open state.

Optionally, the posts 162 may be short enough to not project beyond the top surface 126 of the cover 114. Optionally, the lever arms 174 may be entirely removed and the posts 162 formed integral and rigidly with the top surface 172 of the base 112 provided the posts 162 do not extend beyond the top surface 126 of the cover 114.

Figure 7:
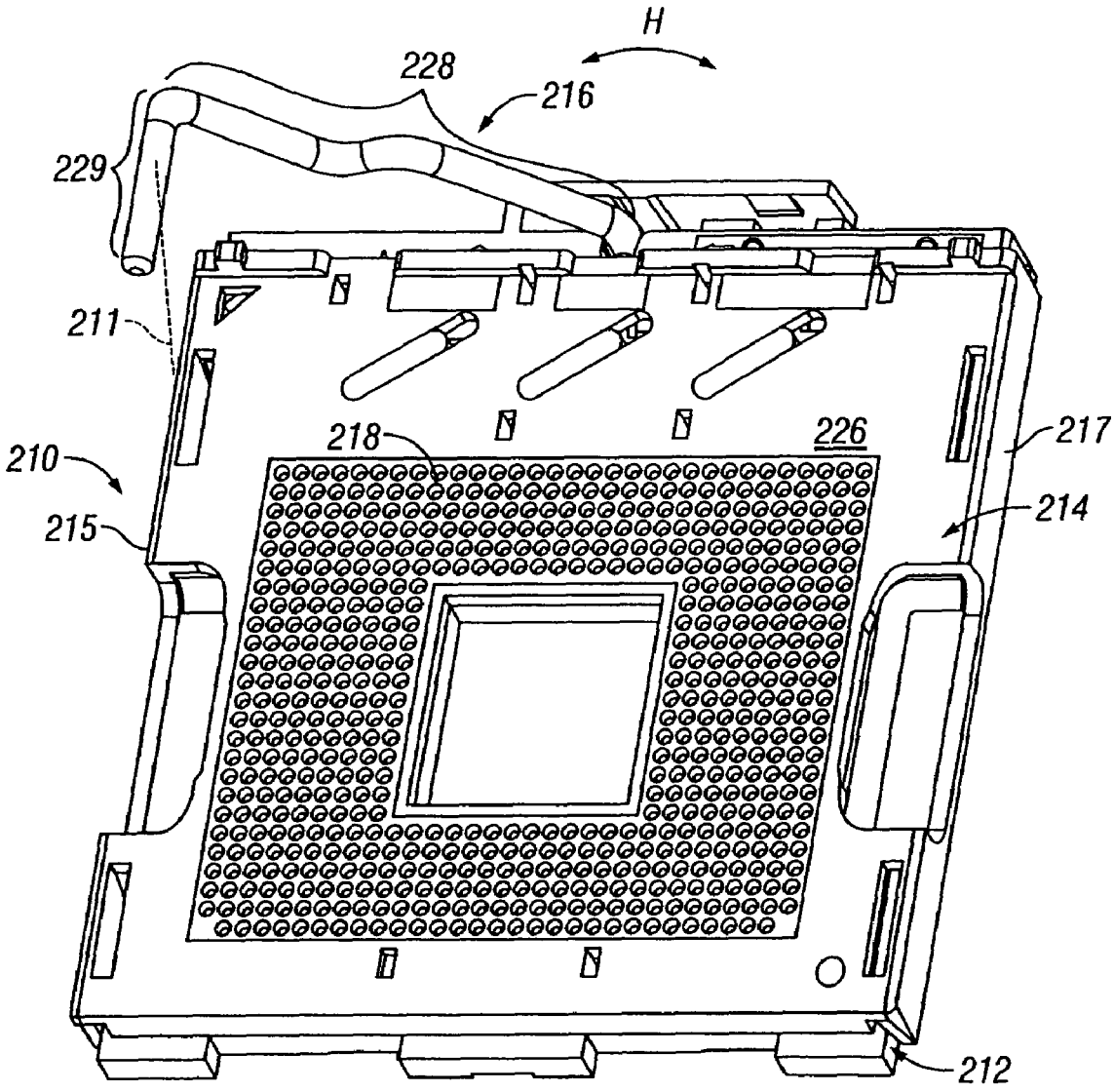
FIG. 7 illustrates an isometric view of a socket formed in accordance with an alternative embodiment of the present invention while in the fully open state.
Figure 8:
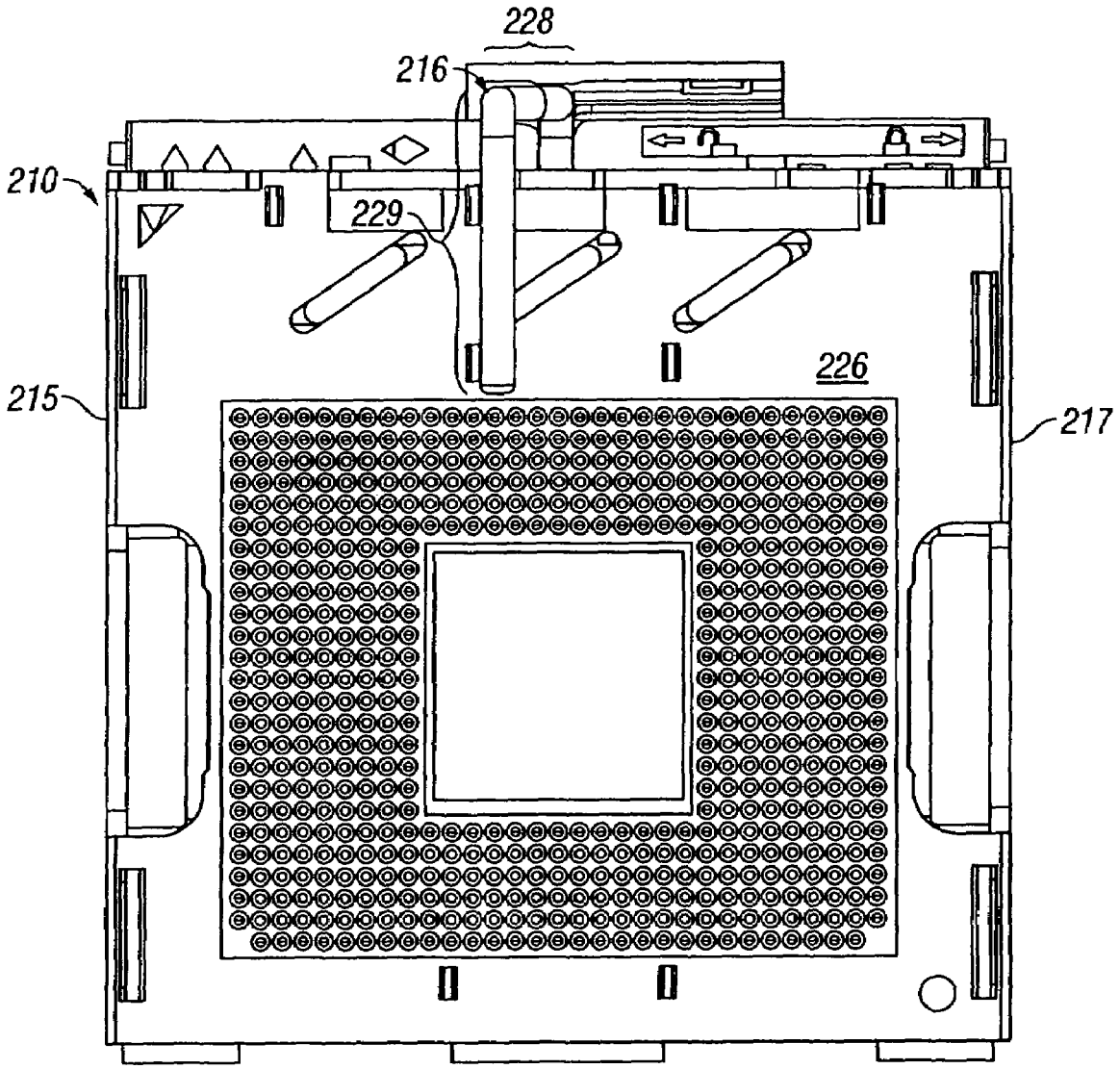
FIG. 8 illustrates a top plan view of the socket of FIG. 7 while in an intermediate state between fully open and closed states.
Figure 9:
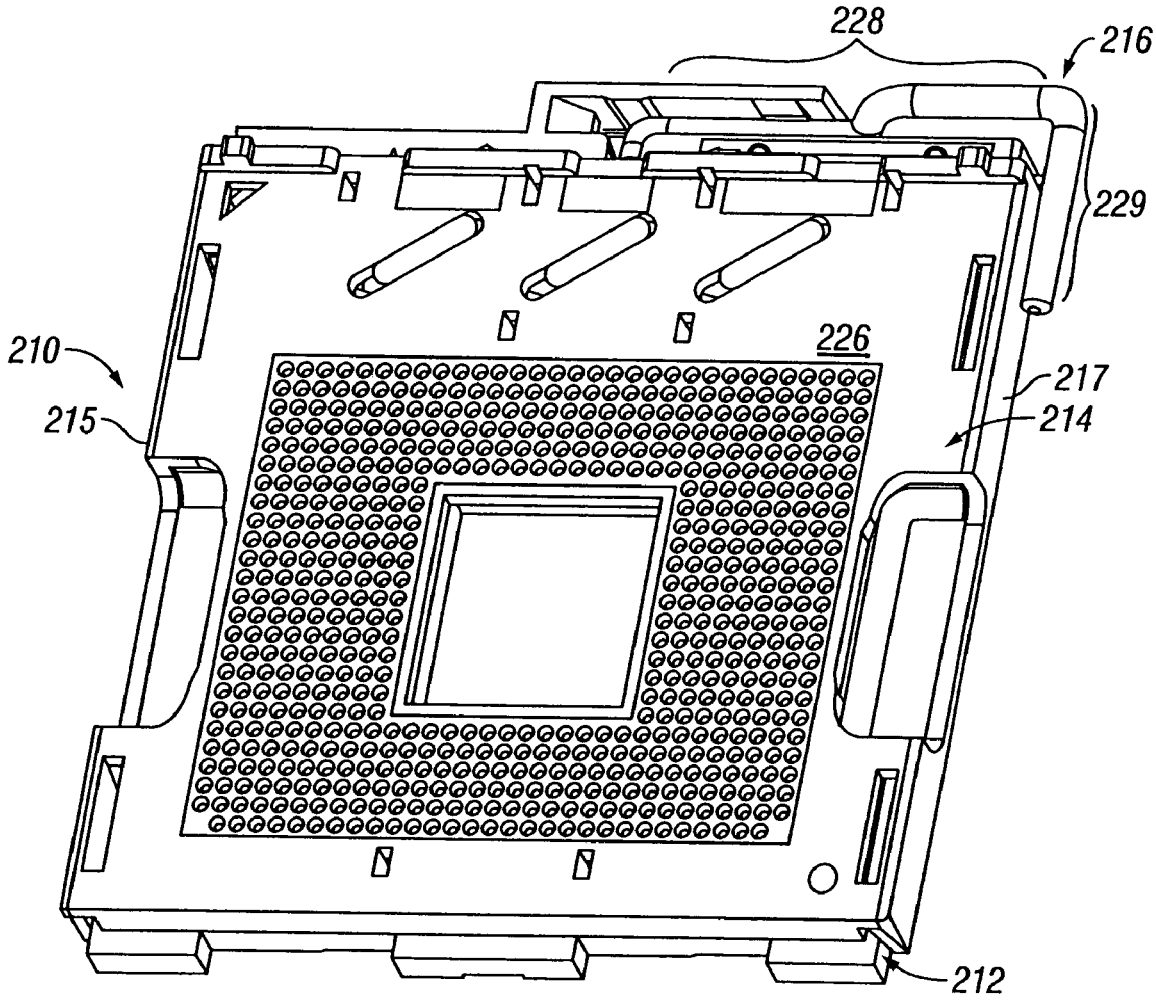
FIG. 9 illustrates an isometric view of the socket of FIG. 7 when in a fully closed state.

FIGS. 7–9 illustrate an alternative embodiment of a socket 210 having a base 212 and a cover 214. A lever 216 is configured with a handle portion 228 and an interference element 229 formed on the end of the handle portion 228. The interference element 229 is bent at a right angle to the handle portion 228 and oriented to project over the top surface 226 of the cover 214. As the lever 216 is moved along an arcuate path H, the interference element 229 moves through an area above the top surface 226 through which the electronic package must be inserted to be loaded on to a pin hole pattern 218 in the cover 214.

FIG. 8 illustrates a top plan view of the socket 210 with the lever 216 provided at an intermediate point along its range of motion between fully open and fully closed states. When the lever 216 is at the intermediate state illustrated in FIG. 8, the interference element 229 is positioned directly above the top surface 226 at a point that blocks loading of an electronic package.

Returning to FIG. 7, when the lever 216 is rotated to the fully open state, the interference element 229 is positioned proximate side 215 of the socket 210 outside of the loading area. The outer envelope of the loading area is denoted by dashed line 211 which extends perpendicular to the side 215. The interference element 229 is outside of the envelope 211 and thus is no longer directly above the top surface 226. Hence, when in the fully open position, the lever 216 does not prevent insertion of the electronic package.

FIG. 9 illustrates the lever 216 in a fully closed position with the interference element 229 located proximate the side 217 of the socket 210. The interference element 229 as shown in FIG. 9 is positioned remote from the top surface 226, thereby avoiding interference with the electronic package. Hence, the interference element 229 serves as a state indicator that informs the user of the state of the socket 210.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A socket for an electronic package, comprising:

a cover and base slidably joined with one another;

an actuator driving said cover and base between open and closed states as said actuator is rotated through a range of motion between open and closed positions, respectively; and a socket state indicator including a wall securely attached to an end of said base, said wall extending upward beyond said cover and having a detent positioned to engage said actuator at an intermediate point along a length of said actuator to provide during rotation of said actuator a tactile release when said actuator reaches said open position, a relative position of said actuator with respect to said socket state indicator indicating to the user when said cover and base are in said open state.

2. A socket for an electronic package, comprising:

a cover and base slidably joined with one another;

an actuator driving said cover and base between open and closed states as said actuator is rotated through a range of motion between open and closed positions, respectively; and a socket state indicator securely attached to said base and engaging said actuator during rotation of said actuator, a relative position of said actuator with respect to said socket state indicator indicating to the user when said cover and base are in said open state, said socket state indicator including a wall extending upward beyond said cover, said wall including a ramped detent extending from one side of said wall at a height to engage said actuator at an intermediate point along said actuator and resisting motion of said actuator as said actuator rotates along an arcuate path past said ramped detent.

3. The socket of claim 1, further comprising a shroud located proximate an end of said base, said shroud having a wall joined to said end of said base at spacers that are separated by a channel proximate a central portion of said wall, said central portion of said wall flexing as said actuator is rotated there past.

* * * * *